US005687941A

United States Patent [19]

Quintile

[11] Patent Number: 5,687,941

[45] Date of Patent: Nov. 18, 1997

[54] HANGING APPARATUS ADAPTED FOR ATTACHMENT TO A LADDER

[76] Inventor: Suzanne M. Quintile, 719 Salem La., Brunswick, Ohio 44212

[21] Appl. No.: 546,911

[22] Filed: Oct. 23, 1995

[51] Int. Cl.[6] ..... E06C 7/14

[52] U.S. Cl. ..... 248/210; 248/311.3; 248/211

[58] Field of Search ..... 248/210, 211, 248/287.1, 301, 214, 311.3

[56] References Cited

U.S. PATENT DOCUMENTS

| | | | |
|---|---|---|---|
| 371,665 | 10/1887 | Brinkerhoff | 248/301 X |
| 982,604 | 1/1911 | Herring | 248/211 |
| 1,601,652 | 9/1926 | Sohnle | 248/211 |
| 1,808,647 | 6/1931 | Fazekas | 248/211 |
| 1,865,283 | 6/1932 | Sohnle | 248/210 X |
| 1,880,319 | 10/1932 | Iasillo | 248/301 X |
| 2,308,180 | 1/1943 | Larsen et al. | 248/238 |
| 2,508,258 | 5/1950 | Heinrich | 248/210 |
| 2,541,434 | 2/1951 | Nelson et al. | 248/210 |
| 2,686,033 | 8/1954 | Keiter | 248/211 |
| 2,703,215 | 3/1955 | Weiss | 248/210 |
| 2,920,853 | 1/1960 | Bufogle | 248/287.1 X |
| 3,156,443 | 11/1964 | Lupinacci | 248/211 |
| 3,220,682 | 11/1965 | Hannon | 248/211 |
| 3,223,369 | 12/1965 | Benninger, Jr. | 248/210 |
| 3,332,653 | 7/1967 | Hoelzel | 248/210 |
| 3,809,351 | 5/1974 | Bravo et al. | 248/210 |
| 3,979,097 | 9/1976 | Balne | 248/211 |
| 5,069,411 | 12/1991 | Murphy | 248/287.1 X |
| 5,305,977 | 4/1994 | Roth | 248/210 |

FOREIGN PATENT DOCUMENTS

| | | | |
|---|---|---|---|
| 2646503 | 4/1978 | Germany | 248/210 |
| 531992 | 6/1958 | Italy | 248/287.1 |
| 281091 | 6/1952 | Switzerland | 248/211 |
| 1022505 | 3/1966 | United Kingdom | 248/211 |

*Primary Examiner*—Leslie A. Braun
*Assistant Examiner*—Stephen S. Wentsler

[57] ABSTRACT

A universally adaptable hanger for suspending a can from a ladder has a ladder rung engaging member which fits over the top and front and rear faces of a ladder rung, and a hanger arm attached generally perpendicularly to the ladder rung engaging member to laterally traverse front and side surfaces of a side vertical member of a ladder and an outboard distal end which extends laterally beyond the side vertical member of a ladder to provide a stable hanging point for a can handle.

2 Claims, 5 Drawing Sheets

HANGING APPARATUS ADAPTED FOR ATTACHMENT TO A LADDER

FIELD OF THE INVENTION

The present invention pertains generally to hanging apparatus and in particular to hangers attachable to ladder-like structures.

BACKGROUND OF THE INVENTION

Many attempts have been made to devise apparatus attachable to ladders to hang or support objects to be used while standing on a ladder, such as apparatus to support a paint can on a ladder. Most such devices make use of the ladder rungs as the principal supporting element, such as for example the common "pot hook" which simply hooks over a rung and is clipped to the bail of a paint can. These approaches, such as described for example by U.S. Pat. No. 5,276,943 have several inherent disadvantages, including the instability of a single hanging point of contact with the ladder, positioning of the can behind the ladder opposite the user and requiring the user to reach through the rungs to reach the can, positioning the bail of the can in the way of access, and the inability to telescopically adjust the ladder with the apparatus hooked to it.

Other hanging devices have been configured to engage the side vertical members of a ladder. For example, U.S. Pat. No. 5,106,045 discloses a clamp which fits on the vertical member of ladder and supports a paint can receiving platform. This design has just one or two points of contact with the ladder. And U.S. Pat. No. 3,964,711 describes a bracket which fits underneath a ladder rung and around the vertical side member to provide a paint can hook immediately adjacent the vertical side member. Because the bail of the can is positioned parallel with the rail of the ladder when hung on this device, it obstructs access to the can with a paint brush. Also, because the device is of a fixed riveted construction it cannot be reversed to be secured to an opposite rail of a ladder, therefore requiring dedicated left and right versions. Although these devices represent some advantages by positioning the can to the side of the ladder rather than behind the ladder, they are not, by virtue of the described constructions, easily attached to and removed from the ladder, do not fit different sizes and types of ladder, nor do they provide an especially secure hanging mechanism, and they are bulky and awkward to store. The present invention overcomes these and other disadvantages of the prior art.

SUMMARY OF THE PRESENT INVENTION

The present invention provides a novel apparatus for securely suspending an object such as a paint can from a ladder at a position laterally outboard of the vertical side member or rail of a ladder. In accordance with one aspect of the invention, an apparatus is provided for securely hanging objects from a ladder at a position laterally outboard from a side vertical member of the ladder. The apparatus includes a ladder rung engaging member which fits over a ladder rung by overlapping the entire width of the rung, with a rearward section which fits over a rear face of the rung, a center section which rests on the top of the rung, and a forward section which fits over a forward face of the rung to thereby provide at least three points of contact with the rung. An inboard distal end of a hanger arm is generally perpendicularly attached to the forward section of the rung engaging member whereby an outboard distal end of the hanger arm, having a hinging point configured to receive and engage a paint can bail, is positioned laterally outboard of a vertical member of the ladder with the rung engaging member positioned near the intersection of the rung and the vertical member. The hanger arm further includes an offset positionable adjacent an outside surface of the side vertical member of the ladder, whereby the side vertical member of the ladder is straddled by an inward section of the hanger arm and flanked by the offset and the rung engaging member. With a paint can or other object hung on the outboard distal end of the hanger arm, the offset in the hanger contacts both a front face of the side vertical member and a portion of the outside lateral surface of the vertical member to provide fourth and fifth points of contact between the hanging apparatus and the ladder.

In accordance with another aspect of the invention, the ladder rung engaging member includes a length adjustable center section whereby the hanging apparatus is adaptable to fit upon ladders having different rung configurations and sizes.

In accordance with another aspect of the invention the orientation of the hanger arm relative to the ladder rung engaging member to extend to an opposite lateral side whereby a single hanging apparatus is adaptable to use on a right or left side of a ladder.

In accordance with another aspect of the invention, a universally adaptable hanging apparatus is adjustable for attachment to any ladder having horizontal rung members and vertical side rail members to provide secure five point attachment of a ladder rung engaging member which fits over the top of a rung and a laterally extending hanger arm with a hook provided at an outboard distal end of the hanger arm.

These and other novel aspects of the invention are herein described in particularized detail with reference to the accompanying Figures.

DETAILED DESCRIPTION OF PREFERRED AND ALTERNATE EMBODIMENTS

Figure 6:
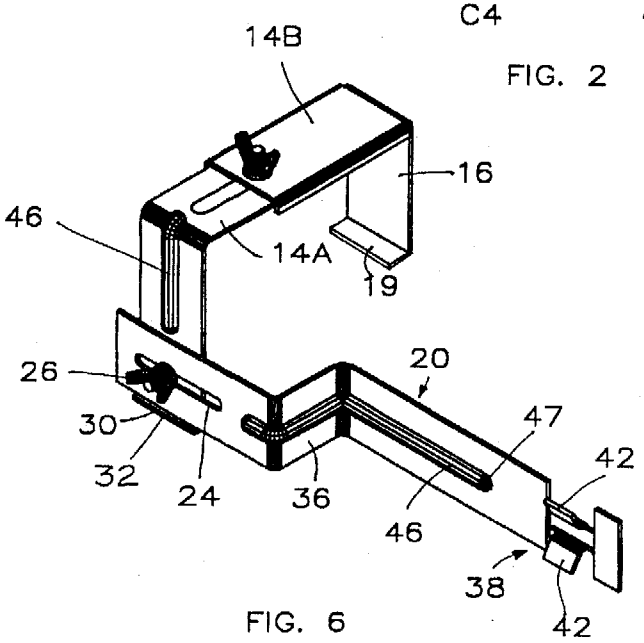
FIG. 6 is a perspective view of an alternate embodiment of the apparatus of the present invention in isolation.
Figure 5:
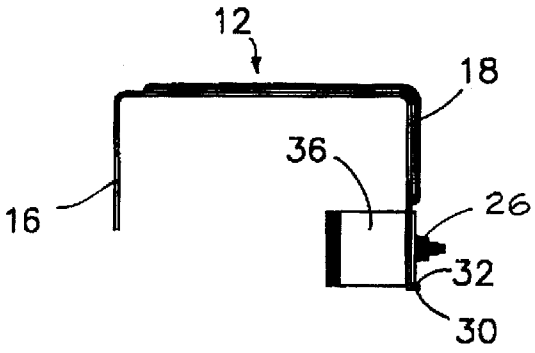
FIG. 5 is a side elevation view of the embodiment of the apparatus of the present invention shown in FIG. 2.
Figure 3:
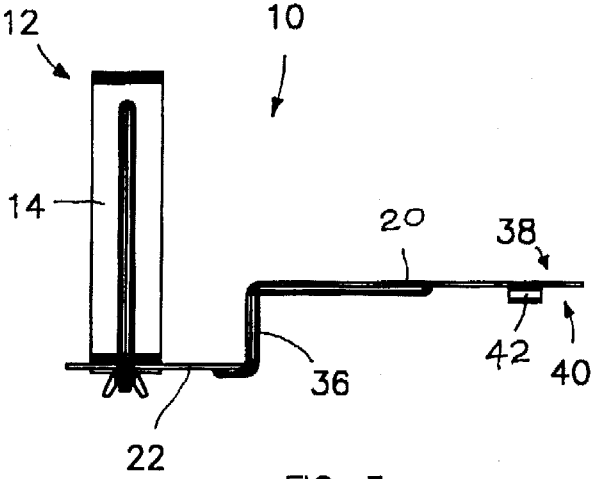
FIG. 3 is a top view of the embodiment of the apparatus of the present invention shown in FIG. 2.

With initial reference to FIGS. 1–5, there is depicted a hanger apparatus, indicated generally at 10, configured for use with a ladder L having rungs R and vertical side members V. The hanger 10 includes a generally U-shaped ladder rung engaging member 12 configured to straddle the entire width of a selected ladder rung R. The ladder rung engaging member 12 includes a center section 14 which traverses and lies flush against a top surface of a rung, a rearward section 16 (visible in FIG. 2) generally perpendicular to center section 14 and positioned to lie flush against a rear surface of rung R, and a forward section 18 also generally perpendicular to center section 14 and positioned to lie flush against a front surface of rung R. The separation distance from rearward section 16 to forward section 18 is determined by the length of center section 14 which may be selectively designed and manufactured to fit upon a ladder rung of any width dimension. As shown in FIG. 6, center section 14 may be comprised of two slidable adjustable fastened sections 14A and 14B which extend perpendicularly from the rearward and forward sections whereby the center section is readily adaptable to fit upon ladder rungs over a range of widths. By this construction, ladder rung engaging member 12 has at least three distinct points of gripping contact, denoted C1, C2 and C3, with rung R to firmly engage a rung of any size or cross-sectional configuration. A distal end 17 of rearward section 16 is ideally suited for binding insertion into the perimeter lid groove common to gallon paint can lids whereby the apparatus can be stored and the paint can/lid lifted by gripping of the ladder rung engaging member. Similarly, when constructed of steel or other rigid material, ends of either the ladder rung engaging member or the hanger arm can be readily used to pry open a can of paint. A lip 19 can be formed to extend generally perpendicularly from rearward section 16 to underlap a ladder rung at the rear edge.

A hanger arm 20 has an inboard distal end 22 attached to the bottom end of forward section 18 of the ladder rung engaging member 12. For example, the inboard distal end 22 may be provided with a slot 24 through which a fastener 26 is passed into and through the bottom end of forward section 18. The bottom edge 28 of forward section 18 is provided with a flange 30 which protrudes perpendicularly to provide a supporting ledge 32 against which an edge 34 of inboard distal end 22 of hanger arm 20 abuts.

Figure 1:
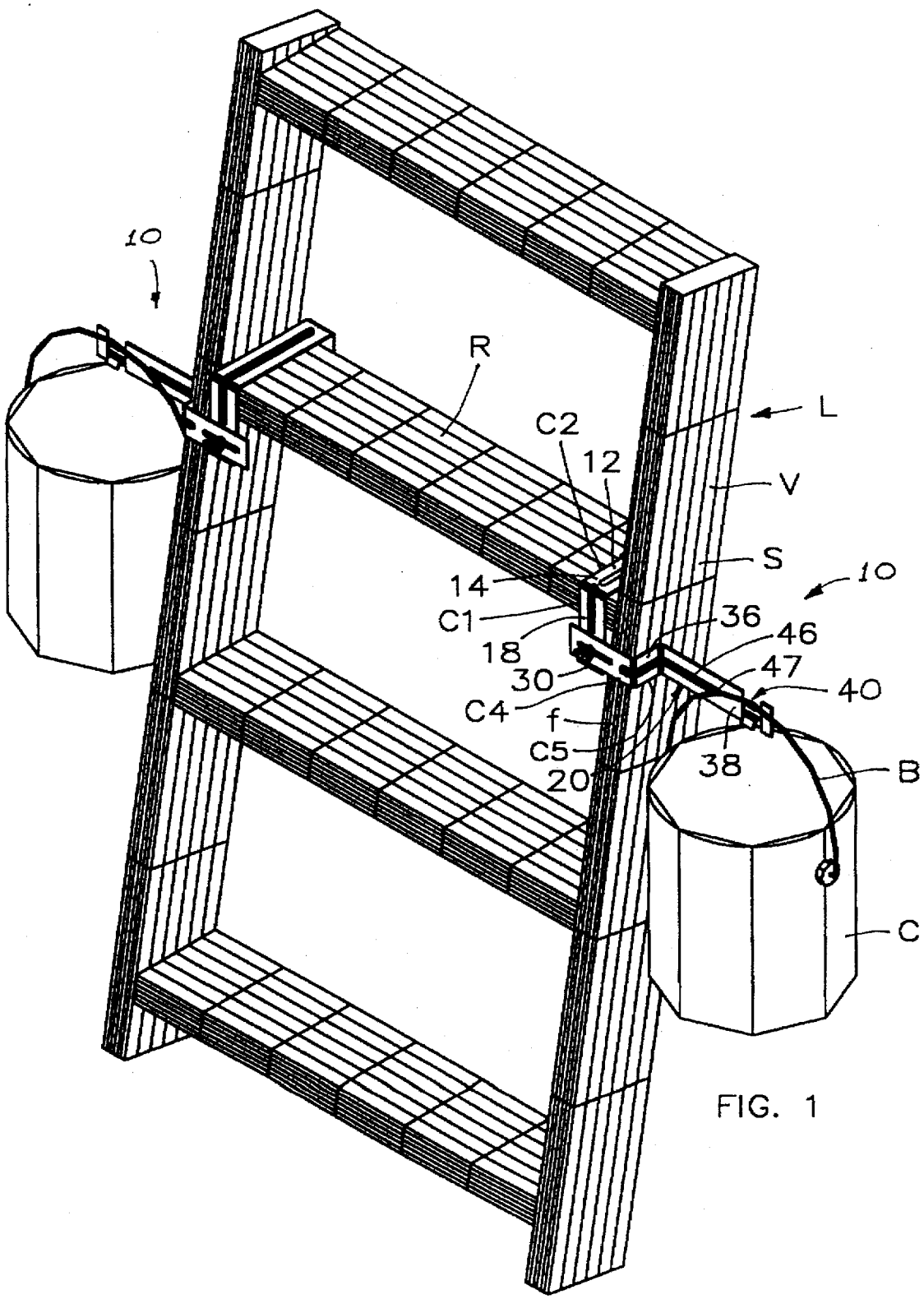
FIG. 1 is a perspective view of one embodiment of the apparatus of the present invention installed upon a ladder.
Figure 2:
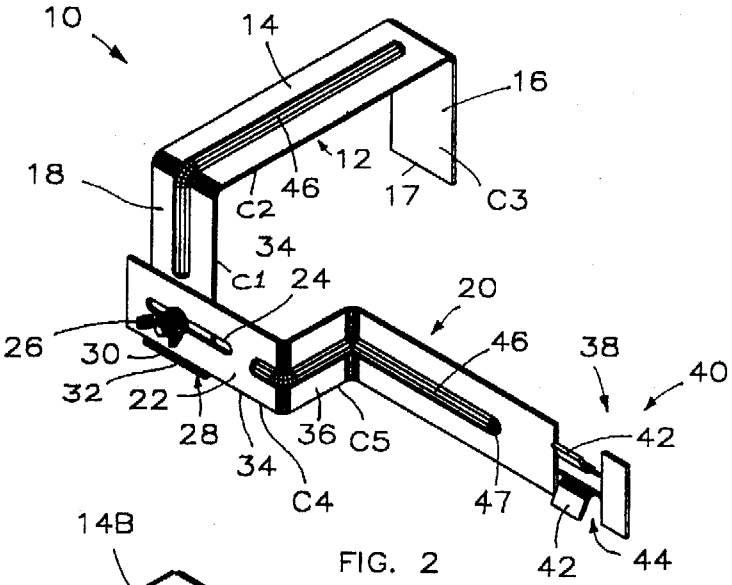
FIG. 2 is a perspective view of one embodiment of the apparatus of the present invention in isolation.
Figure 4:
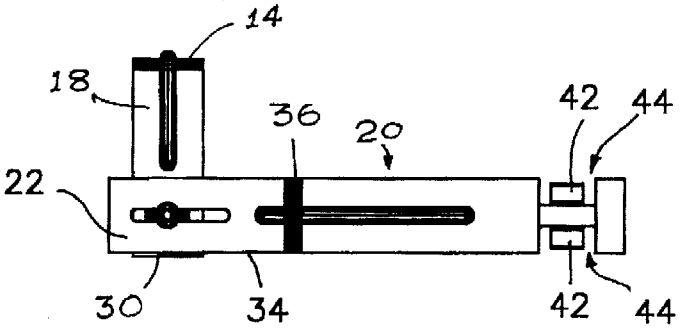
FIG. 4 is a front elevation view of the embodiment of the apparatus of the present invention shown in FIG. 2.
Figure 8:
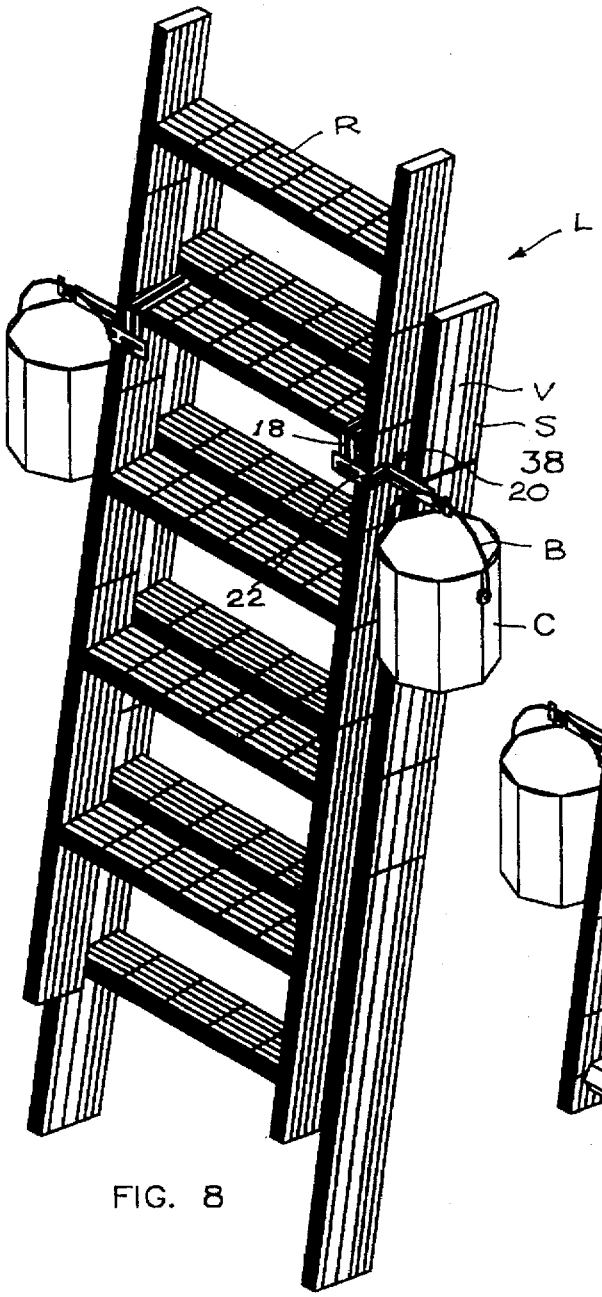
FIG. 8 is a perspective view of one embodiment of the apparatus of the present invention installed upon a telescoping ladder.

Hanger arm 20 further includes an offset 36 in the form of a relatively short section interposed between inboard distal end 22 and an outboard distal end 38. Offset 36 is positionable, by selective adjustment of hanger arm 20 relative to the ladder rung engaging member via slot 24 and fastener 26, flush against an exterior side s of vertical member V of ladder L. With the ladder rung engaging member 12 placed tightly at the intersection of rung R with vertical member V, and secured to the hanger arm with the offset 36 firmly against the vertical member, the apparatus 10 effectively entraps and latches to both the rung R and the section of the vertical member V proximate to the end of the rung, at five points of contact denoted C1–C5. The hanger arm 20 is mechanically restricted from rotation about the linear axes of either the inboard or outboard distal ends by the section of the inboard distal end 22 which traverses the front face f vertical member V and the section secured flush against forward section 18 of the ladder rung engaging member. The outboard distal end 38 extends a substantial distance laterally from offset 36 and side s of the ladder to accomplish true vertical suspension from a specially adapted hook 40 of a standard U.S. gallon size paint can C with the paint can bail B in general alignment with the outboard distal end 38. When a load such as a can of paint is applied to hook 40, points of contact C4 and C5 impinge upon vertical member V to grip the ladder by a dual moment force. Outboard distal end 38 can be angled slightly toward the plane of front face f to further enhance positioning and access of a can suspended from hook 40. In a preferred embodiment, the length of outboard distal end 38 (as measured from offset 36 to hook 40) is substantially greater than the length of offset 36. As shown in FIGS. 2 and 4, a symmetrical hook 40 formed on each side of distal end 38 has a tab 42 slightly offset from the plane of outboard distal end 38 and flanked by two notches 44. The tab and notches form a channel for receiving the wire bail of a paint can (including a plastic grip over the central section of the bail). This arrangement aligns the bail B with the hanger arm and out of the path of access to the can. By engaging the bail B in the two notches 44, the can is prevented from pivoting. To orient the hanger arm 20 to extend laterally beyond an opposite side of the ladder it is simply loosened or detached from the rung engaging member and rotated 180° relative to forward section 18 of the rung engaging member and re-fastened about the ladder vertical member. Of course, multiple hangers may be used on one or both sides of a ladder as shown in FIGS. 1, 7B and 8. The removable fastener securement of the ladder rung engaging member and the hanger arm enable the device to be easily folded into a single plane configuration for storage.

Structural ribs 46 in the central span areas of the ladder rung engaging member 12 and hanger arm 20 provide structural rigidity and contour to these members. As shown in FIG. 1, a terminal point 47 of rib 46 of hanger arm 20 serves as a positioning guide by tangential contact with a point of bail B to eliminate lateral swinging and further secure positioning of the can C upon the apparatus.

Figure 7A:
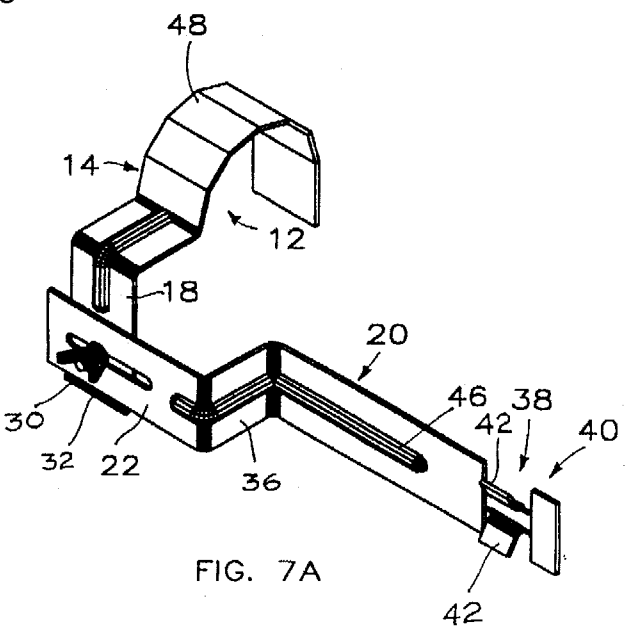
FIG. 7A is a perspective view of an alternate embodiment of the apparatus of the present invention in isolation.
Figure 7B:
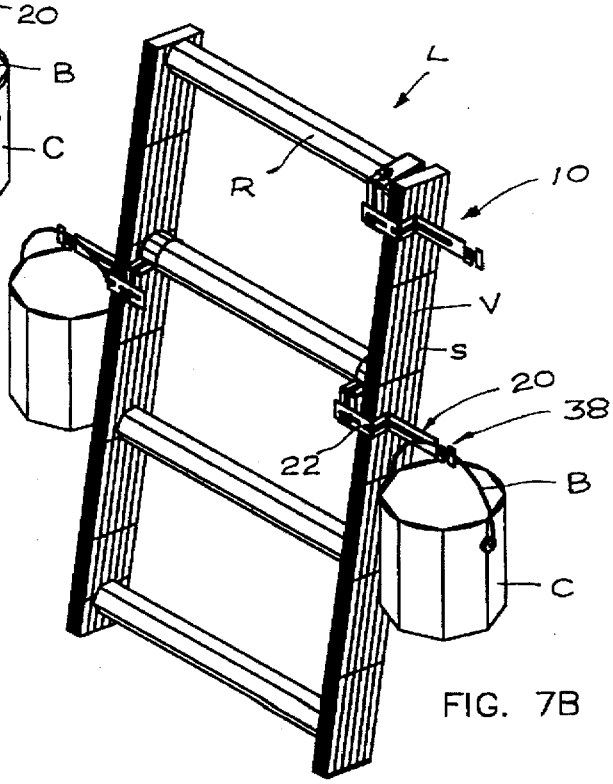
FIG. 7B is a perspective view of the alternate embodiment of the apparatus of the present invention shown in FIG. 7A in combination with a ladder.

FIGS. 7A and 7B illustrate an alternate embodiment of the hanging apparatus 10 wherein a section 48 of center section 14 is alternately configured to engage for example a ladder rung having a more arcuate or curved cross section, with the structure of the remainder of the apparatus essentially unaltered. Of course, attachment of the apparatus is not dependent upon the internal construction or material of a ladder, such as wooden with solid rungs, aluminum with hollow rungs, or fiberglass and is therefore universally adaptable.

Figure 9:
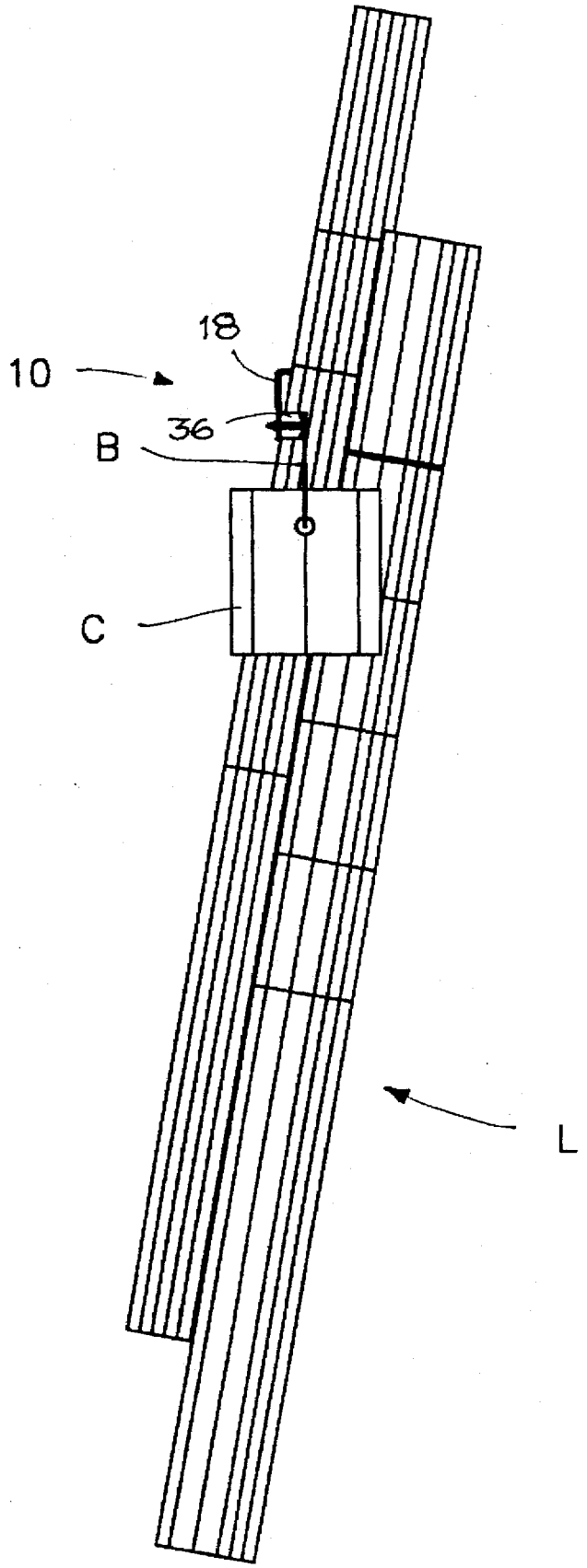
FIG. 9 is a side elevation view of the apparatus of the present invention installed upon a telescoping ladder.

FIG. 8 illustrates an inherent advantage of the apparatus which enables use in connection with a common telescoping extension ladder wherein the hanger is engaged upon the rung of the forward telescoping section of the ladder without interference with the base section. The lateral extension of outboard distal end 38 of hanger arm 20 is sufficient to position the can C laterally beyond the base section to allow the can to be suspended truly vertically and out of contact with the base section of the ladder, as shown in FIG. 9, thereby minimizing chance of spillage from a suspended can.

In use, because the ladder rung engaging member 12 fits over the top of a rung, it is readily lifted and positionable upon a different rung by, for example, gripping the hanger arm, with fingers closed about the outboard distal end 38 and the thumb pad against the inboard distal end 22, lifting the apparatus off of one rung and placing it on another rung, even with a loaded can suspended from hook 40. As the load is removed from hook 40, contact points C4 and C5 are relieved and the ladder rung engaging member 12 is either loosened or simply lifted from the rung.

Although the invention has been described with respect to certain embodiments and methods of use and applications, it will be appreciated by those of skill in the art that certain modifications and variations could be made which are within the scope and spirit of the invention as described by the specification and defined by the claims, including all equivalents thereto.

What is claimed is:

1. A device for hanging a can of paint from a ladder at a point laterally outboard of a vertical member of the ladder, and with a paint can bail oriented generally parallel to rungs of the ladder so that the bail does not obstruct access to the can by a person on the ladder, the device comprising:

a ladder rung engaging member configured to fit over the top of a ladder rung, the ladder rung engaging member having adjustably interconnected rearward and forward sections, the rearward and forward sections each being generally L-shaped with a horizontal part and a vertical part extending downward and generally perpendicular to the horizontal part, the horizontal part of the forward section having an elongate slot in a central area, and the horizontal part of the rearward section aligned with and at least partially overlapping the horizontal part of the forward section, an adjustable fastener through the horizontal part of the rearward section and through the elongate slot in the horizontal part of the forward section, whereby a total length of the horizontal parts of the rearward and forward sections is selectively adjustable to span a top surface of the ladder rung, whereby the vertical part of the rearward section is positionable against a rear surface of the ladder rung, and the vertical part of the forward section is positionable against a front surface of the ladder rung, the vertical part of the forward section further comprising a structural rib formed in a central longitudinal area of the vertical part, and a flange at a bottom distal end which extends generally perpendicularly forward of the vertical part to form a supporting surface which is generally perpendicular to the vertical part and generally parallel to the horizontal part of the forward section, a hanger arm having an inboard distal end adjustably attached to the bottom distal end of the vertical part of the forward section of the ladder rung engaging member to extend generally perpendicular from the vertical part of the forward section and laterally from the vertical member of the ladder, a bottom edge of the inboard distal end of the hanger arm resting upon the flange at the bottom distal end of the vertical part of the forward section of the ladder rung engaging member, the inboard distal end of the hanger arm further comprising an elongate longitudinal slot intersected by a fastener which also intersects the bottom distal end of the vertical part of the forward section of the ladder rung engaging member whereby an extent to which the hanger arm extends laterally from the ladder rung engaging member is adjustable, the hanger arm further having an outboard distal end and an offset between the inboard distal end and the outboard distal end, the offset being generally perpendicular to the inboard and outboard distal ends and generally parallel the vertical member of the ladder on which the ladder rung engaging member is engaged, whereby the offset is positionable against an outside surface of the vertical member of the ladder by adjustment of the fastener through the slot in the inboard distal end of the hanger arm, whereby the vertical member of the ladder is effectively clamped between the ladder rung engaging member and the offset of the hanger arm, top and bottom edges of the outboard distal end of the hanger arm further comprising a paint can bail hook having a single tab offset from a plane of the outboard distal end and a notch on each side of the tab to form a channel for receiving the paint can bail and orienting the bail in a plane parallel with the outboard distal end of the hanger arm so that access to an interior of the can by the person standing on the ladder to which the device is attached is unobstructed by the bail.

2. A hanging apparatus for attachment to a ladder to provide a hanging point for suspension of objects to a side of the ladder, the apparatus comprising:

a two part ladder rung engaging member having a generally L-shaped rearward section adjustably connected to a generally L-shaped forward section, the rearward section having a first part positionable across a top surface of a ladder rung and a second part generally perpendicular to the first part and positionable against a rearward surface of the ladder rung, the forward section having a first part positionable across the top surface of the ladder rung and a second part generally perpendicular to the first part and positionable against a frontward surface of the ladder rung, a portion of the first part of the rearward section aligned with and overlapping a portion of the first part of the forward section, an adjustment slot in the first part of the forward section, and a fastener extending through the overlapping portions of the rearward and forward sections and through the adjustment slot, a combined length of the first parts of the rearward and forward sections sufficient to span the top surface of the ladder rung, a bottom edge of the second part of the forward section having a flange which protrudes perpendicularly from the second part of the forward section to form a ledge perpendicular to the second part of the forward section, a hanger arm having an inboard distal end adjustably attached to the second part of the forward section of the ladder rung engaging member, the hanger arm positionable to extend laterally and generally perpendicularly from the second part of the forward section of the ladder rung engaging member, the hanger arm further having an offset adjustably positionable against an outside surface of a vertical member of the ladder by adjustment at the point of attachment to the second part of the forward section of the ladder rung engaging member, and an outboard distal end extending laterally outward from the offset, with a hook in the form of a tab flanked by two notches to form a channel which is parallel to the outboard distal end of the hanger arm, whereby a load applied to the hook forces the inboard distal end of the hanger arm against the flange of the forward section of the ladder rung engaging member which in turn forces an edge of the ladder rung engaging member against an inside surface of the vertical member of the ladder and the offset against the outside surface of the vertical member of the ladder, whereby the hanging apparatus grippingly engages the rung and vertical member of the ladder.

* * * * *